US009357823B2

(12) United States Patent
Boldetti et al.

(10) Patent No.: US 9,357,823 B2
(45) Date of Patent: Jun. 7, 2016

(54) LUGGAGE FRAME STRUCTURE

(71) Applicant: Samsonite IP Holdings S.a r.l., Luxembourg (LU)

(72) Inventors: Massimiliano Boldetti, Castronno (IT); Davide Caimi, Bovisio Masciago (IT)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 14/358,552

(22) PCT Filed: Nov. 15, 2012

(86) PCT No.: PCT/EP2012/072697

§ 371 (c)(1),
(2) Date: May 15, 2014

(87) PCT Pub. No.: WO2013/072405

PCT Pub. Date: May 23, 2013

(65) Prior Publication Data

US 2014/0291095 A1 Oct. 2, 2014

Related U.S. Application Data

(60) Provisional application No. 61/560,141, filed on Nov. 15, 2011.

(51) Int. Cl.
*A45C 13/04* (2006.01)
*A45C 3/02* (2006.01)
(Continued)

(52) U.S. Cl.
CPC . *A45C 13/04* (2013.01); *A45C 3/02* (2013.01); *A45C 7/0059* (2013.01); *A45C 13/02* (2013.01); *A45C 13/36* (2013.01)

(58) Field of Classification Search
CPC .. A45C 13/04; A45C 2005/037; A45C 13/26; A45C 3/02; A45C 7/0036; A45C 7/0059; A45C 13/36
USPC ..... 190/24, 103, 107, 127, 900, 18 R, 37; 383/107–109, 111, 2, 119; 150/128; 403/169, 305; 3/24, 103, 107, 127, 3/900; 220/6, 651
See application file for complete search history.

(56) References Cited

U.S. PATENT DOCUMENTS 1,155,475 A * 10/1915 Fay ..... 220/9.3
1,329,194 A * 1/1920 Makruzin ..... 190/122

(Continued)

FOREIGN PATENT DOCUMENTS

DE 3627524 A1 * 2/1988
EM 001947854-0003 11/2011

(Continued)

OTHER PUBLICATIONS

PCT International Search Report dated Feb. 11, 2013, International Application No. PCT/EP2012/072697, 3 pages.

*Primary Examiner* — Sue A Weaver
(74) *Attorney, Agent, or Firm* — Dorsey & Whitney LLP

(57) ABSTRACT

Frame structures (106*a*, 106*b*, 206) for luggage pieces (100) formed of one or more frame supports (110, 210) and one or more frame elements (108) may be assembled with the luggage piece. Luggage pieces may include an outer layer (102), an inner layer (104), and at least one frame structure (106*a*, 106*b*, 206) with one or more frame elements (108) and one or more frame supports (110, 210). The frame elements (108) may be joined to the inner layer (104), the outer layer (102), or both, and may be arranged between the outer layer (102) and the inner layer (104). The frame supports (110, 210) may be joined to the outer layer (104), and one or more frame elements (108) may be joined to the frame supports (110, 210). The frame structures (106*a*, 106*b*, 206) may provide support and/or reinforcement to the luggage piece (100).

20 Claims, 8 Drawing Sheets

(51) Int. Cl.

| | |
|---|---|
| ***A45C 13/02*** | (2006.01) |
| ***A45C 13/36*** | (2006.01) |
| ***A45C 7/00*** | (2006.01) |

(56) References Cited

U.S. PATENT DOCUMENTS

| | | | | | |
|---|---|---|---|---|---|
| 2,010,428 | A | * | 8/1935 | Finkelstein | 190/127 |
| 2,016,520 | A | | 10/1935 | Short | |
| 2,039,913 | A | * | 5/1936 | Lifton | 190/127 |
| 2,104,935 | A | | 1/1938 | Solomon | |
| 2,474,003 | A | * | 6/1949 | Lifton | 190/124 |
| 2,689,631 | A | | 9/1954 | Marks | |
| 2,779,371 | A | | 1/1957 | Klehr | |
| 2,806,563 | A | | 9/1957 | Einhorn | |
| 3,587,794 | A | | 6/1971 | Mattel | |
| 3,592,314 | A | * | 7/1971 | Jacobson | 190/19 |
| 4,239,074 | A | * | 12/1980 | Kahn | 190/115 |
| 4,813,520 | A | | 3/1989 | Lin | |
| 5,031,734 | A | * | 7/1991 | King | 190/122 |
| 5,155,895 | A | * | 10/1992 | Jakiela et al. | 29/453 |
| 5,251,731 | A | | 10/1993 | Cassese et al. | |
| 5,476,184 | A | | 12/1995 | Hill | |
| 5,620,069 | A | | 4/1997 | Hurwitz | |
| 6,131,713 | A | * | 10/2000 | Sher | 190/122 |
| 7,090,399 | B2 | * | 8/2006 | Godshaw et al. | 383/119 |
| 7,896,154 | B2 | * | 3/2011 | Boatner | 206/221 |

FOREIGN PATENT DOCUMENTS

| | | | |
|---|---|---|---|
| FR | 2602649 | A1 * | 2/1988 |
| GB | 2462099 | A | 1/2010 |
| TW | 201125511 | A | 1/2011 |
| WO | 2011089376 | A2 | 7/2011 |
| WO | 2013072405 | A1 | 5/2013 |

* cited by examiner

LUGGAGE FRAME STRUCTURE

CROSS-REFERENCE TO RELATED APPLICATIONS

This application is the national stage application of International Patent Application No. PCT/EP2012/072697 filed on Nov. 15, 2012 and entitled "Luggage Frame Structure" which claims the benefit, under 35 U.S.C. §119(e), to U.S. Provisional Patent Application No. 61/560,141, entitled "Frame Structure for Luggage" and filed on Nov. 15, 2011, the entire contents of which are hereby incorporated by reference herein in their entireties.

TECHNOLOGICAL FIELD

The technological field generally relates to luggage, and more particularly to frame structures for luggage.

BACKGROUND

Luggage pieces, such as suitcases or briefcases, are often used to transport items that may be heavy. In addition, luggage pieces may be heavy due to the materials and components used to construct the luggage pieces. As a result, difficulty in transporting heavy items may be compounded by the weight of the luggage piece. Thus, luggage weight is often an important consideration when designing a piece of luggage. Additionally, while some soft sided luggage pieces, such as soft sided duffel bags, may be free of support components, such as polypropylene sheets that add rigidity to the luggage piece, this may not be practical for all types of luggage.

Another issue with luggage involves its size. For luggage pieces that are intended to be used for air travel, there are often restriction's placed on the permissible size of the luggage piece. Further, when not being used, luggage pieces often take up valuable storage space. Accordingly, for at least certain types of luggage, it is sometimes desirable for a luggage piece to be at least partially collapsible while still maintaining its general shape in order to minimize its dimensions for certain situations, such as carrying the luggage piece onto a plane or storing it.

To address some of these issues regarding weight and size, one possible approach when designing a luggage piece is to utilize frame structures that provide shape to the luggage piece and also allow the luggage piece to be selectively collapsed. Examples of various types of such frame structures may be found in the following publications: G.B. Publication No. 2 462 099; U.S. Pat. No. 2,016,520; U.S. Pat. No. 2,689,631; U.S. Pat. No. 2,806,563; U.S. Pat. No. 4,813,520; U.S. Pat. No. 5,251,731; U.S. Pat. No. 5,476,184; and U.S. Pat. No. 5,620,069. However, these luggage pieces and frame structures suffer from various deficiencies.

For example, many of the frame structures require a user to re-arrange at least some of the frame components in order to collapse the luggage piece. This may be undesirable as it usually requires either the frame to be exposed or access to be provided to the frame. Further, these types of frames often include moving parts that may wear out or break, thus potentially undesirably reducing the life span of the luggage piece.

Accordingly, there is a need for luggage that can address one or more of these and other deficiencies in existing luggage.

SUMMARY

Described herein are frame structures for luggage made of an assembly of frame components that support, maintain, and/or reinforce the structure of the luggage piece or portions thereof. The frame structures may allow for the luggage piece to be changed from an expanded configuration to a collapsed configuration without moving any of the frame components that form a particular frame relative to the other frame components of the frame. The frame components may be relatively small or lightweight. One or more of these advantages or other advantages described herein may allow for the construction of a lightweight luggage piece that addresses at least some of the problems described above.

In some implementations, a luggage piece may include an outer layer and a first frame. The first frame may include at least two first frame components connected to each other. The at least two first frame components support the outer layer for a first shape and a second shape of the luggage piece and allow portions of the outer layer to be altered without any of the first frame components moving relative to the other first frame components when changing the luggage piece from the first shape to the second shape and vice versa.

In some implementations, the luggage piece may include an outer layer and a first frame. The first frame may include at least two first frame components, and the first frame may support the outer layer. The at least two first frame components may be connected to each other and positioned relative to the outer layer to maintain a shape of a first portion of the outer layer for a first shape and a second shape of the luggage piece and to allow other portions of the outer layer to be altered without any of the first frame components moving relative to the other first frame components when changing the luggage piece from the first shape to the second shape and vice versa.

In some implementations, a luggage piece may include an outer layer, a first frame, and a second frame. The first frame may include two or more first frame elements operatively coupled by first frame supports, and preferably may include at least three first frame elements and at least two first frame supports. The first frame may support the outer layer. The second frame may include two or more second frame elements operatively coupled by second frame supports, and preferably may include at least three second frame elements and at least two first frame supports. The second frame may support the outer layer. The luggage piece may include no frame elements that join the first frame to the second frame, and the first frame and the second frame may not share any common frame supports. In some of these implementations, the first frame, the second frame, and the outer layer may be configured to allow the first and second frames to be selectively moved towards or away from each other to alter the luggage piece between a first shape and a second shape, wherein preferably the first shape is an expanded configuration of the luggage piece, and preferably the second shape is a collapsed configuration of the luggage piece.

In some implementations, the second frame may include at least two second frame components connected to each other. The at least two second frame components may support the outer layer for the first shape and the second shape of the luggage piece and allow portions of the outer layer to be altered without any of the second frame components moving relative to the other second frame components when changing the luggage piece from the first shape to the second shape and vice versa.

In some implementations, the at least two second frame components may maintain a shape of a second portion of the outer layer for the first shape and the second shape of the luggage piece and to allow the other portions of the outer layer to be altered without any of the second frame components moving relative to the other second frame components when changing the luggage piece from the first shape to the second shape and vice versa.

In some implementations, the first and second frames may be selectively moved either towards or away from each other to change the luggage piece between the first shape and the second shape.

In some implementations, the at least two first frame components may include at least two first frame elements, preferably three first frame elements, and one or more first frame supports, preferably two first frame supports. Each of the least two first frame elements may be joined to at least one of the one or more first frame supports.

In some implementations, the at least two second frame components may include at least two second frame elements, preferably three second frame elements, and one or more second frame supports, preferably two second frame supports. Each of the least two second frame elements may be joined to at least one of the one or more second frame supports.

In some implementations, at least one of the first and second frames may be at least partially positioned between the outer layer and an inner layer that is operatively joined to the outer layer.

In some implementations, at least one of the at least two first frame elements and/or at least one of the two second frame elements may be coupled to either the outer layer or the inner layer by being positioned within a channel defined by either the outer layer or the inner layer and a cover. The cover may be joined to either the outer layer or the inner layer.

In some implementations, at least one of the one or more first frame supports and/or at least one of the one or more second frame supports may be positioned at a corner of the luggage piece, preferably a bottom corner, and may form a portion of an outer surface of the luggage piece.

In some implementations, at least one of the one or more first frame supports and/or at least one of the one or more second frame supports may include a bent frame connection structure. The bent frame connection structure may include at each end an elongated hole. Each elongated hole may be sized to receive therein a portion of one of the at least two first frame elements or one of the at least two second frame elements.

In some implementations, at least one of the one or more first frame supports and/or at least one of the one or more second frame supports may be operatively attached to the outer layer to secure the first frame and/or the second frame, respectively, to the outer layer. Preferably, said at least one of the one or more first frame supports and/or second frame supports includes a plate-like structure or a support edge for securing the first frame and/or the second frame, respectively, to the outer layer. Preferably, when the at least one of the one or more first frame supports and/or second frame supports includes the bent frame structure and the plate-like structure, the plate-like structure may extend radially away from the bent frame connection structure.

In some implementations, at least one of the at least two first frame elements and/or at least one of the at least two second frame elements includes an end portion that is not joined to any of the one or more first frame supports or to any of the one or more second frame supports, respectively.

In some implementations, at least two first frame supports may be used for the first frame. One of the at least two first frame elements may be joined to one of the least two first frame supports at a first end portion of the one of the at least two first frame elements and may be joined to another of the least two first frame supports at a second end portion of the one of the least two first frame supports where the second end portion is distal from the first end portion.

In some implementations, at least two second frame supports may be used for the second frame. One of the at least two second frame elements may be joined to one of the least two second frame supports at a first end portion of the one of the at least two second frame elements and may be joined to another of the least two second frame supports at a second end portion of the one of the least two second frame supports where the second end portion is distal from the first end portion.

In some implementations, at least two first frame elements and one or more first frame supports may be configured to form a generally U-shaped structure for the first frame.

In some implementations, at least two second frame elements and one or more second frame supports may be configured to define a generally U-shaped structure for the second frame.

In some implementations, the outer layer may include two or more panels. The first frame components of the first frame may be generally positioned along at least a portion of the periphery of one panel of the two or more panels and/or the second frame components of the second frame may be generally positioned along at least a portion of the periphery of one panel of the two or more panels. Preferably, each panel of the two or more panels is oriented to be generally orthogonal to adjacent panels of the two or more panels.

In some implementations, the outer layer may be a flexible material. The flexible material may be a fabric, leather, or any other suitable flexible material used for luggage.

In some implementations, at least some of the first frame components and/or at least some of the second frame components may be elongated members, such as elongated fiberglass pultrusions.

In some implementations, the first shape may be an expanded configuration for the luggage piece, and the second shape may be a collapsed configuration for the luggage piece In some implementations, at least some of the first and/or second frame components, including, but not limited to, the one or more first frame supports or the one or more second frame supports, may reinforce the outer layer.

In some implementations, assemblies for luggage pieces may include frame structures formed from one or more supports and one or more frame elements. The one or more supports and frame elements may be assembled with a luggage piece to provide support and reinforcement to the luggage piece.

In some embodiments, the support assembly may include a lining configured to be received in an interior of the luggage piece, and the lining may include covers configured to receive the frame elements along one or more of a vertical and a horizontal length of the lining.

In some embodiments, the support assembly may include a support interior with one or more frame element connection members configured to receive terminal ends of the frame elements.

In some embodiments, the one or more supports may be arranged at one or more bottom corners of the luggage piece.

In some embodiments, a first frame structure may provide support and reinforcement to a front panel of the luggage piece and a second frame structure may provide support and reinforcement to a back panel of the luggage piece.

In other implementations, the luggage piece may include an outer layer. The luggage piece may further include a means for supporting the outer layer for the first shape and the second shape of the luggage piece and for allowing other portions of the outer layer to be altered without any components of the support means moving relative to the other components of the support means when changing the luggage piece from the first shape to the second shape and vice versa. This support means may be joined to the outer layer, an inner layer joined to the outer layer, or both. Preferably, the support means may include the first frame.

In other implementations, the luggage piece may include an outer layer. The luggage piece may further include a means for maintaining a shape of a first portion of the outer layer for the first shape and the second shape of the luggage piece and for allowing other portions of the outer layer to be altered without any components of the means moving relative to the other components of the shape maintaining means when changing the luggage piece from the first shape to the second shape and vice versa. This means may be joined to either the inner layer or the outer layer. This shape retaining means may be joined to the outer layer, an inner layer joined to the outer layer, or both. Preferably, the shape retaining means may include the first frame.

In some implementations, the luggage piece may further include a second means for supporting the outer layer for the first shape and the second shape of the luggage piece and for allowing other portions of the outer layer to be altered without any components of the support means moving relative to the other components of the support means when changing the luggage piece from the first shape to the second shape and vice versa. This second support means may be joined to the outer layer, the inner layer, or both. Preferably, the second support means may include the second frame.

In some implementations, the luggage piece may further include a second means for maintaining a shape of a second portion of the outer layer for the first shape and the second shape of the luggage piece and for allowing other portions of the outer layer to be altered without any components of the second shape retaining means moving relative to the other components of the second shape retaining means when changing the luggage piece from the first shape to the second shape and vice versa. The second means may be joined to the outer layer, the inner layer, or both. Preferably, the second shape retaining means may include the second frame.

In another implementation, a luggage piece may include an outer layer, an inner layer, and at least one frame structure. The outer layer may define an open end and a closed end. The inner layer may define an open end and a closed end. The inner layer may be configured to be received by the outer layer at its open end. The at least one frame structure may include one or more frame elements and one or more frame supports. The frame elements may be configured to be joined to the inner layer and to be arranged between the outer layer and the inner layer. The frame supports may be configured to join to the outer layer at the closed end of the outer layer. The one or more frame elements may be joined to each of the one or more supports. The at least one frame structure may provide support and reinforcement to the luggage piece.

This summary is provided to aid in understanding the luggage piece, and one of skill in the art will understand that each of the various aspects and features of the luggage piece may advantageously be used separately in some instances, or in combination with other aspects and features of the luggage piece in other instances.

DETAILED DESCRIPTION

Described herein are frame structures for use with a soft sided suitcase or other types of luggage. The frame structures may provide support and/or reinforcement to the luggage piece, for example, along portions of its length, height and width. The frame structures may be assembled with frame components, such as frame elements and frame supports. In some implementations, the frame elements may be provided as elongated rods, struts, shafts, or pultrusions. The frame elements may be formed of a rigid or semi-rigid material. The frame elements may help to maintain luggage piece's shape and/or may reinforce other materials forming the luggage piece.

The frame supports may be selectively joined to one or more of the frame elements via frame element connection features. In some embodiments, the frame supports may be configured as corner elements for use at the external corners of the luggage piece. The frame supports may be formed of rigid or semi-rigid materials, some of which may resist scuffing and/or function as a shock absorber. The frame structures may be joined to an inner layer of material that defines an interior of the luggage piece, to an outer layer of material that defines a shape of the luggage piece, or to both inner and outer layers of material. In some implementations, the frame structures may be used in luggage pieces to reduce its weight compared to luggage pieces incorporating other types of support components, such as polypropylene sheets.

The frame structures may be sized and shaped for any size or shape of luggage. However, the frame structures are particularly suitable for luggage pieces having a rectangular cube-shape. The luggage pieces may include soft sides, hard sides, or combinations thereof and may be formed from any type of material or construction used to form luggage pieces, including, but not limited to, fabrics (e.g., nylon), plastics (e.g., acrylonitrile butadiene styrene ("ABS"), polycarbonate, polypropylene, polyethylene, etc.), natural materials (e.g., leather, plywood), metals, or some combination thereof. The luggage pieces may further include an outer layer and an inner layer, such as a lining, formed from any of the materials described above. The inner layer may define one or more compartments of the luggage piece.

The luggage pieces may also include any of the following: two or more wheels for moving the luggage piece along a support surface, one or more carry handles to lift or otherwise move the luggage piece, a telescoping handle to facilitate moving the luggage piece along a support surface via the wheels, edge piping to help protect the outer surface of the luggage piece from scuffs and abrasions, and at least one perimeter zipper or other releasable closure element that allows for selective access to one or more compartments of the luggage piece.

Figure 1:
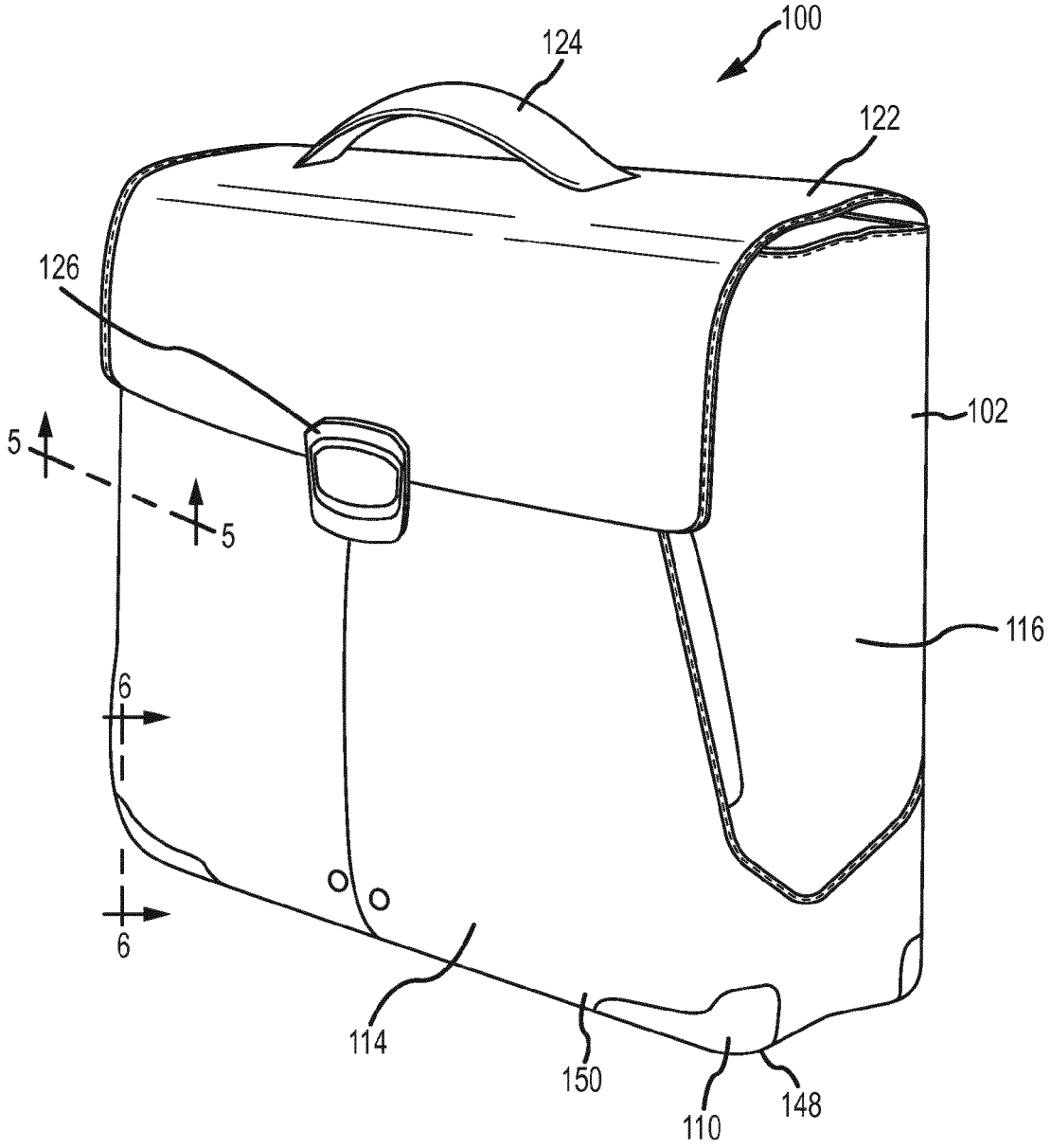
FIG. 1 shows a front perspective view of a luggage piece that includes one or more frame structures.
Figure 2:
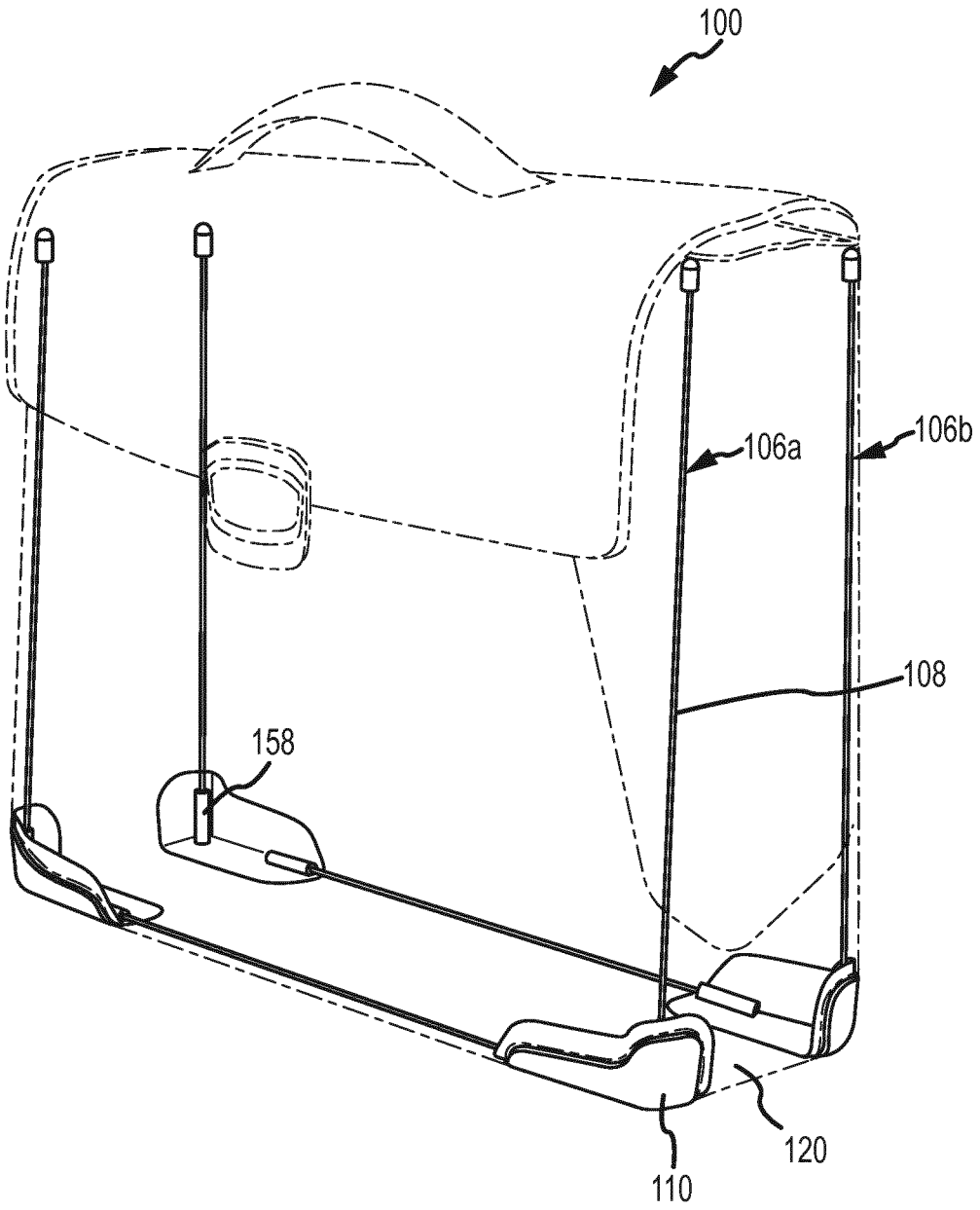
FIG. 2 shows a front perspective view of a first frame and a second frame for the luggage piece of FIG. 1, with an outer layer shown in phantom line.
Figure 3:
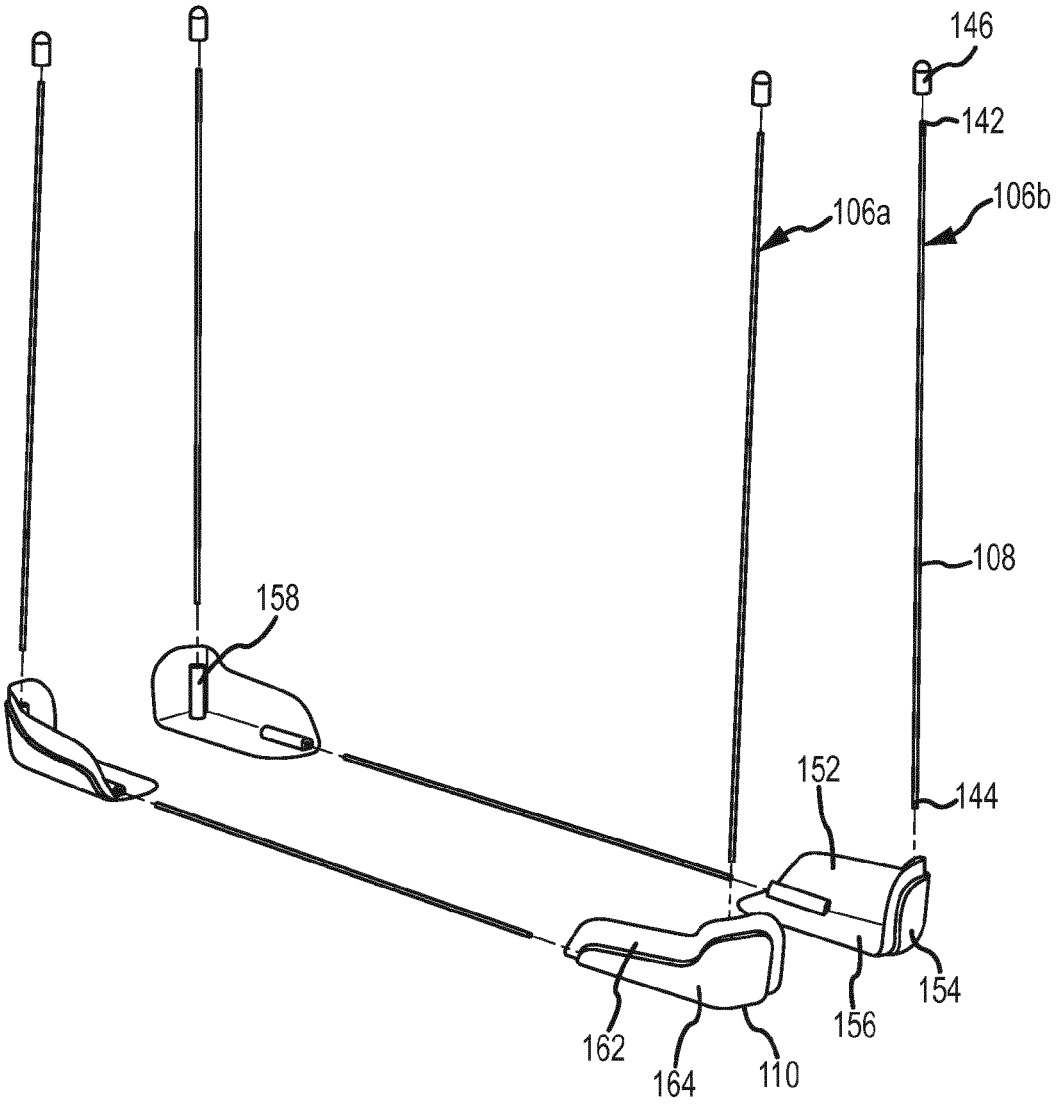
FIG. 3 shows an exploded perspective view of the first and second frame.
Figure 4:
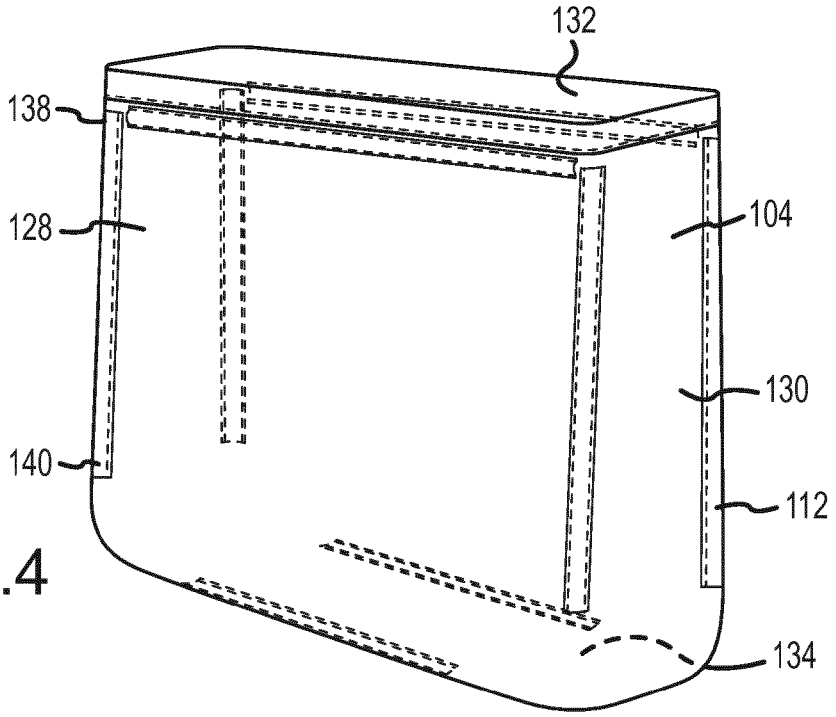
FIG. 4 shows a front perspective view of an inner layer of the luggage piece of FIG. 1.

FIG. 1 shows a front perspective view of a luggage piece. FIG. 2 shows a front perspective view of first and second frames for the luggage piece of FIG. 1. FIG. 3 shows an exploded view of the first and second frames prior to assembly with the other components of the luggage piece. FIG. 4 shows a front perspective view of an inner layer of the luggage piece of FIG. 1.

With reference to FIGS. 1-4, the luggage piece 100 may include an outer layer 102 that defines one or more outer surfaces of the luggage piece 100, an inner layer 104 that defines one or more inner surfaces of the luggage piece 100, and one or more frame structures, such as a first frame 106*a* and a second frame 106*b*. The first frame 106*a* and the second frame 106*b* may each support the outer layer 102, the inner layer 104, or both layers, and the first frame 106*a* and the second frame 106*b* may each reinforce the outer layer 102, the inner layer 104, or both layers.

Each frame structure 106*a-b* may include one or more frame components, such as one or more frame elements 108 and one or more frame supports 110. For the first frame 106*a*, the frame components may be referred to as first frame components, the frame elements 108 may be referred to as first frame elements, and the frame supports 110 may be referred to as second frame supports. Similarly, for the second frame 106*b*, the frame components may be referred to as second frame components, the frame elements 108 may be referred to as second frame elements, and the frame supports 110 may be referred to as second frame supports. The frame components of the first frame 106*a* and the second frame 106*b*, including, but not limited to, the first frame supports 110 and the second frame supports 110, may support and/or reinforce any of the other materials of the luggage piece 100, including, but not limited to, the outer layer 102 and the inner layer 104.

Each frame support 110 may be joined to at least some of the frame elements 108. One or more covers 112 may be joined the inner layer 104, the outer layer 102, or both layers. The covers 112 may be utilized to operatively join the first frame 106*a* and the second frame 106*b*, via their respective frame elements 108, to the inner layer 104, the outer layer 102, or both layers.

Figure 9:
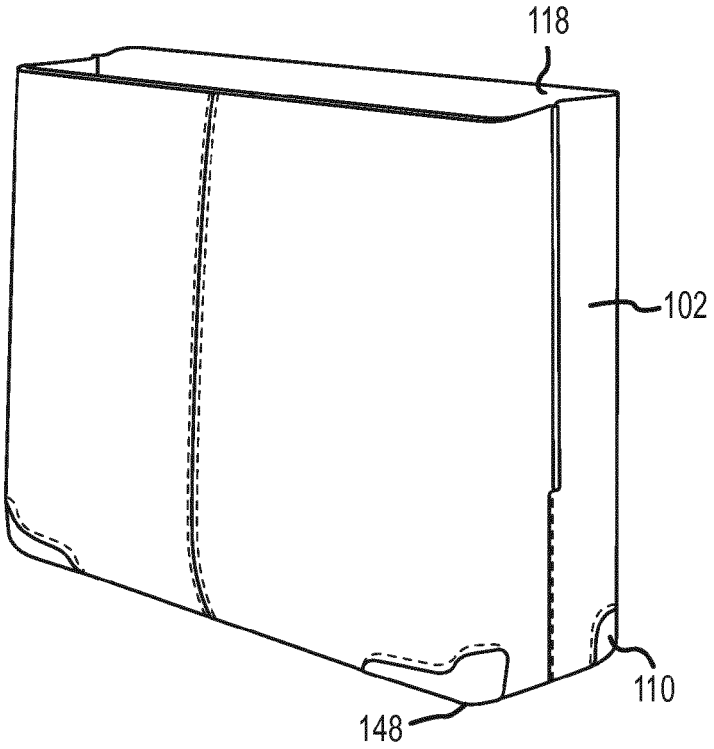
FIG. 9 shows a perspective view of the outer layer of the luggage piece of FIG. 1, showing frame supports joined to the outer layer.
Figure 10:
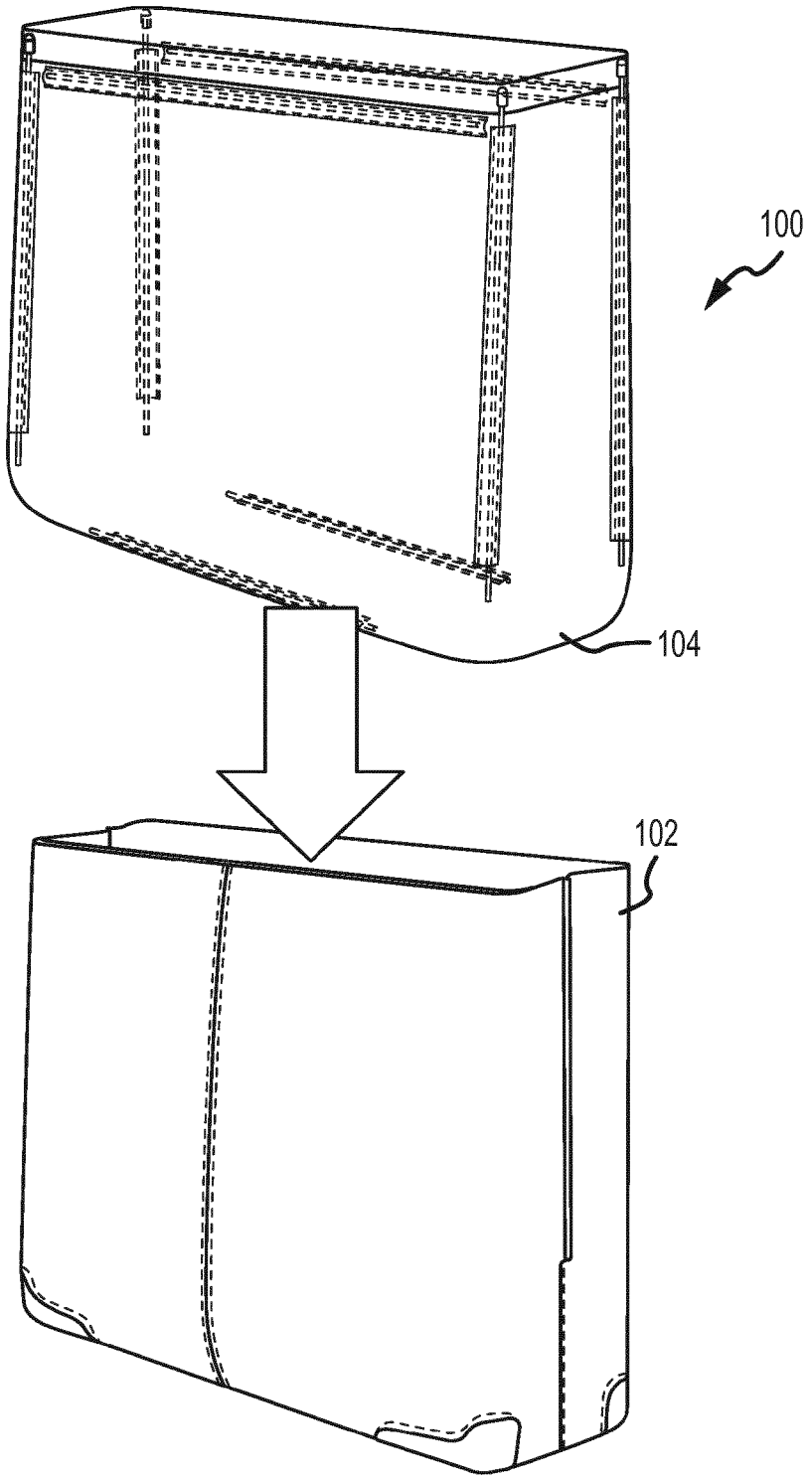
FIG. 10 shows a perspective view of the inner layer and the outer layer of the luggage piece of FIG. 1, showing the inner layer prior to positioning the inner layer within a space defined by the outer layer.

With reference to FIGS. 1, 2, and 9, the outer layer 102 may include a front exterior panel 114, side exterior panels 116, a back exterior panel 118, a bottom exterior panel 120, and a top exterior panel 122. Each panel 114, 116, 118, 120, 122 may be generally orthogonally oriented to adjacent panels, or arranged to form any other desired shape.

The front, side, back, bottom, and top exterior panels 114, 116, 118, 120, 122 may define a selectively enclosed outer layer space. The outer layer space may be sized to be sufficiently large to receive the inner layer 104 and at least some frame components 108, 110 of the frame structures 106*a-b* therein. The top exterior panel 122 may be selectively moved relative to the other exterior panels 114, 116, 118, 120 to create an outer layer opening that allows for access to the outer layer space. The inner layer 104 and at least some frame components 108, 110 of the frame structures 106*a-b* may be moved through the outer layer opening in order to position the inner layer 104 and the at least some frame components 108, 110 of the frame structures 106*a-b* within the outer layer space. The top exterior panel 122 may include a handle 124 and a releasable closure member 126 for selectively joining the top exterior panel 122 to the front exterior panel 114.

With reference to FIG. 4, among other figures, the inner layer 104, which may take the form of a lining, may include a front inner panel 128, side inner panels 130, a back inner panel 132, and a bottom inner panel 134. The various inner panels 128, 130, 132, 134 may collectively define a generally rectangular box shape, or any other suitable shape. The front, side, and back inner panels 128, 130, 132 may further define an inner layer opening. The inner layer opening may be substantially co-extensive with the outer layer opening. The inner layer 104 may define a main enclosed space or compartment of the luggage piece.

Each of the front exterior and inner panels 114, 128 may alone, or collectively with the other panel, form a front panel of the luggage piece 100. Each of the side exterior and inner panels 116, 130 may alone, or collectively with another of the side panels, form one of the side panels of the luggage piece 100. Each of the back exterior and inner panels 118, 132 may alone, or collectively with the other panel, form a back panel of the luggage piece 100. Each of the bottom exterior and inner panels 120, 134 may alone, or collectively with the other panel, form a bottom panel of the luggage piece 100.

The panels 114, 116, 118, 120, 122 for the outer layer 102 may be formed using a single piece of material, or may be formed using two or more pieces of material. Similarly, the panels 128, 130, 132, 134 for the inner layer 104 may be formed using a single piece of material, or may be formed using two or more pieces of material. When multiple pieces of material are used for the outer layer 102 and/or the inner layer 104, the material may be the same type of material or different type of material. For example, the outer layer 102 may be formed entirely from a single type of material, such as nylon or leather, or may be formed from two or more types of materials, such as nylon and leather. Portions or the entirety of the outer layer 102 and/or inner layer 104 may also be formed using two or more different types of material suitably joined together to form a composite layer. For example, portions or the entirety of the outer layer 102 and/or inner layer 104 may be a fabric or the like that is backed with a foam or the like.

The outer layer 102 and the inner layer 104 may be constructed so that the inner layer 104 abuts the outer layer 102. For example, the inner layer 104 may be configured with dimensions that may be slightly smaller than the dimensions of the outer layer 102, which may allow the inner layer 104 to slide into outer layer space defined by the outer layer 102 during assembly of the luggage piece 100, which is described below.

Figure 5:
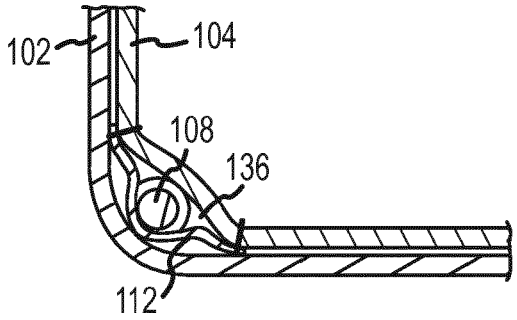
FIG. 5 shows a cross-section view of the luggage piece of FIG. 1, viewed along line 5-5 in FIG. 1.

With reference to FIGS. 4 and 5, each cover 112 may be joined to the inner layer 104. Each cover 112 may take the form of an elongated material, which may be generally rectangular in shape. Each cover 112 may be joined to the inner layer 104, to the outer layer 102, or to both layers along lengthwise edges of the cover 112 using any suitable connection method, such as sewing. Further, for each cover 112, the inner layer 104 and the cover 112, or the outer layer 102 and the cover 112, may collectively define cover channels 136 that are accessed via cover openings defined at opposing end portions 138, 140 of the cover. Each cover channel 136 may be configured to receive a frame element 108 of one of the frame structures 106*a-b*, and each cover 112 may have a length that is approximately the same as the length of its corresponding frame element 108. However, in some implementations, each cover 112 may have a length that is longer or shorter than the length of its corresponding frame element 108.

Each cover 112 may extend generally horizontally, vertically, or any other desired direction along the inner layer 104. Each cover 112 may be positioned at, or adjacent to, one of the corners of the inner layer 104, proximate to an edge of the inner layer 104, or at any portion of the inner layer where frame elements 108 are used to provide support, shape maintenance, reinforcement, and/or rigidity to the luggage piece 100. For example, and with reference to FIG. 4, there may be four vertically extending covers 112 and four horizontally extending covers 112. Each vertically extending cover 112 may be located proximate to a corner that joins either the front inner panel 128 to a side inner panel 130 or the back inner panel 132 to a side inner panel 130, thus providing support, shape maintenance, reinforcement, and or rigidity to the corners of the luggage piece 100.

Returning to FIGS. 3, 5 and 6, the frame elements 108 or other frame components may be formed as straight, elongated members, such as rods, struts, shafts, pultrusions, and so on. In some implementations, the frame elements 108 or other frame components may be constructed of fiberglass, stainless steel, aluminum, composites, or other materials that help the frame elements 108 or other frame components maintain their shape while providing some elasticity. The frame elements 108 may be configured with a hollow or a solid cross-section. At least one end portion of each frame element 108 may be configured to enable insertion of the frame element 108 through a respective cover channel 136. Each frame element 108 may be configured to allow end portions 142, 144 of the frame element to extend beyond the ends of its respective cover 112 when the frame element 108 is positioned within the cover channel 136 of its respective cover 112. The cross-section area taken transversely to the length the each frame element 108 may be sized to allow the frame element 108 to be received within the cover channel 136 defined by its respective cover 112. At least one of the end portions 142, 144 of at least some of the frame element ends 108 may be joined to one of the frame supports 110 as described below, to protective elements 146 (e.g., caps), to the outer layer 102, or to end portions 142, 144 of other frame elements 108.

With reference to FIG. 1, each frame support 110 of the frame structures 106*a-b* may be arranged one of the bottom corners 148 of the luggage piece 100. Further, in some implementations, the frame supports 110 may form a portion of the outer surface 150 of the luggage piece 100, such as the portion of the outer surface 150 of the luggage piece 100 at the bottom corner 148. In these implementations, the frame supports 110 may advantageously provide scuff protection, reinforcement and/or support to the outer and/or inner layers 102, 104, and/or desired aesthetic configurations at these bottom corners 148 or other outer surface portions of the luggage piece 100. In others implementations, other materials, such as fabric or leather, may cover the frame supports 110 and may provide scuff protection and/or desired aesthetic configurations at the bottom corners 148 or other outer surface portions of the luggage piece 100.

With reference to FIGS. 2 and 3, each frame support 110 may include three sides, in which a first side 152 is positioned along the front or back, exterior and/or inner, panel 114, 118, 128, 132 of the luggage piece 100, a second side 154 is positioned along a side, exterior and/or inner, panel 116, 130 of the luggage piece 100, and a third side 156 is positioned along the bottom, exterior and/or inner, panel 120, 134 of the luggage piece 100. In some implementations, the frame supports 110 may be provided as support structures along other portions of the luggage piece 100, such as along a corner where two panels join. In this example, the frame supports 110 may form an L-shape. The frame supports 100 may be formed of rigid or relatively rigid materials, such as plastic (e.g., ABS or polycarbonate), rubber, polypropylene, polyethylene, metals, fiberglass, or some combination thereof.

Each frame support 110 may include one or more frame element connection structures 158, which may be provided on an interior facing side of the frame support 110. Each frame element connection structure 158 may be configured to join one of the frame elements 108 to the frame support 110. With reference to FIG. 2, each frame element connection structure 158 may be joined to a single frame element 108, and each frame support 110 may include two frame element connection structures 158. Openings formed in the frame element connection structures 158 may be configured to enable a respective frame element 108 to join to an internal sidewall 160 (see FIG. 6) of the frame element connection structure 158 by a friction fit, through adhesives, by a threaded connection, or using any suitable boss and fastener connection system. The opening may be configured with a circular shape, but may include any configuration, such as a square, oval, triangular or hexagonal shape, that allows the frame element end portion 142, 144 to be received within the hollow space defined the internal sidewall 160 of the frame element connection structure 158.

In some implementations, each frame element connection structure 158 may be fixed to its respective frame support 110 by joining these components via adhesives or welding, or through integrally forming the frame support 110 and the frame element connection structure 158 as a unitary structure. In alternative implementations, the frame element connection structures 158 may be selectively movable relative to their respective frame supports 110. For example, the frame element connection structures 158 may pivot, rotate, slide, or otherwise move relative to their respective frame supports 110. The frame element connection structures 158 may be formed of rigid materials such as those described above in relation to the frame supports 110, and the material forming the frame element connection structures 158 may be the same or different from the material forming the frame supports 110.

Each frame support 110 may include a support edge 162 configured to facilitate joining the frame support 110 to the outer layer 102. The support edge 162 may take the form of a flange extending from a main portion 164 of the frame support 110 and may provide a surface for joining the frame support 110 to the outer layer 102 through any suitable connection method. For example, the frame support 110 may be joined to the outer layer 102 by positioning an inner facing surface of the outer layer 102 against an outer facing surface of the support edge 162 and using mechanical fasteners (e.g., threaded screws, stitches, rivets, snaps and so on), adhesives, welds, or any other known connection mechanism to join the outer layer 102 to the frame support 110 at the interface between the surfaces of the support edge 162 and the outer layer 102. The support edge 162 may be recessed from the other exterior facing portions of the main portion 164 of the frame support 110, which may allow the outer facing surface of the outer layer 102 to be flush with an adjacent outer facing surface of the frame support 110 upon assembly of the luggage piece 100 (see FIGS. 1 and 6).

With reference in FIG. 2, the first and second frames 106*a-b* may be at least partially positioned between the outer layer 102 and the inner layer 104. For example, the frame elements 108 of the first and second frames 106*a-b* may be positioned between the outer and inner layers 102, 104, and the frame supports 110 of the first and second frames 106*a-b* may extend from the interior of the luggage piece 100 to its exterior so that at least a portion of the frame supports 110 form a portion of the outer surface 150 of the luggage piece 100.

Three first frame elements 108 may be assembled with two first frame supports 100 to form the first frame 106*a*, and three second frame elements 108 may be assembled with two second frame supports 110 to form the second frame 106*b*. The first frame 106*a* may be positioned along the bottom and side edges of the periphery of the front exterior panel 114 of the luggage piece 100, and the second frame 106*b* may be positioned along the bottom and side edges of the periphery of the back exterior panel 118 of the luggage piece 100. In this implementation, the three first frame elements 108 and two first frame supports 110 of the first frame 106*a* arranged along the front exterior panel 114 may not be joined by any frame components, such as other frame elements 108, to the three second frame elements 108 and two second frame supports 110 arranged along the back exterior panel 118, and therefore the embodiment of FIG. 2 may be considered to include two frame structures, the front panel or first frame 106*a* and the back panel or second frame 106*b*.

Providing separate frame structures 106*a-b* for the luggage piece 100 allows the first and second frames structures 106*a-b* to provide continuous support to the outer layer 102 of the luggage piece 100 for first and second shapes of the luggage piece 100, while portions of the outer layer 102, such as the sidewalls or side exterior panels 116 defining the width of the luggage piece 100, may be collapsible or otherwise alterable so that, for example, the first and second frames 106*a-b* can be moved towards each other to press the front and back exterior panels 114, 118 together along the width of the luggage piece 100 to change the luggage piece 100 from the first shape, which may be an expanded configuration, to the second shape, which may be a collapsed configuration, and so that the first and second frames 106*a-b* can be moved away from each other to change the luggage piece 100 from the second shape to first shape. Providing separate frame structures 106*a-b* for the luggage piece 100 may also allow the first frame 106*a* and the second frame 106*b* to maintain shapes of first and second portions (e.g., at least lower portions 170 and/or edge portions of the front and rear exterior panels 114, 118 may be maintained by the first and second frames 106*a-b* in a generally rectangular or other shape for at least the lower portion 170 of the front and back exterior panels 114, 118), respectively, of the outer layer 102, while other portions of the outer layer 102, such as the sidewalls or side exterior panels 116 defining the width of the luggage piece 100, may be collapsible or otherwise alterable so that the luggage piece 100 can be changed between the first and second shapes. Moreover, these separate frame structures 106*a-b* allow for the luggage piece 100 to be moved between the first and second shapes (e.g., moved between the expanded and collapsed configurations) without moving any of the first frame components 108, 110 of the first frame 106*a* relative to any of the other first frame components 108, 110 of the first frame 106*a* and/or without moving any of the second frame components 108, 110 of the second frame 106*b* relative to any of the other second frame components 108, 110 of the second frame 106*b*. The collapsed configuration may be useful and advantageous for storage of the luggage piece 100.

The frame structures 106*a-b* shown in FIG. 2 may be configured as U-shaped frame structures. The closed end of each U-shaped frame structure may be arranged along the length of the bottom of the luggage piece 100 proximate to the periphery of either the front or back exterior and/or inner panels 114, 118, 128, 132, or the closed end may be arranged along a vertical length of luggage piece 100, or the closed end may be positioned adjacent to the opening defined by the inner layer 104. In luggage pieces where two U-shaped frame structures 106*a-b* are arranged spaced apart and parallel to each other, the frame element free ends 142 (e.g., the ends of the frame elements 108 receiving the protective elements 146) may provide the frame structures 106*a-b* with some flexibility. For example, the frame element free ends 142 proximate to the opening defined by the inner layer 104 may flex inwardly, outwardly or both. Flexion of the frame elements 108 inwardly and outwardly may enable the upper portions 166, 168 of the front and back exterior and/or inner panels 114, 118, 128, 132 to be drawn together and spread apart, while maintaining the shape of the front and back exterior and/or inner panels 114, 118, 128, 132 along their lower portions 170, 172 and/or maintaining the shape of the front and back exterior and/or inner panels 114, 118, 128, 132 along at least some edges (e.g., left, right, and bottom edges) of these panels 114, 118, 128, 132. In addition, the front and back exterior and/or inner panels 114, 118, 128, 132 of the luggage piece 100 may be drawn together or spread apart relative to one another along the upper portions 166, 168 of the luggage piece 100, for example, proximate to the opening defined by the inner layer 104, due in part, to the frame elements 108 having free end portions 142 that are not joined to another rigid structure.

The frame structures 106*a-b* may include more or less frame elements 108 and frame supports 110 than the configuration shown in FIGS. 2 and 3, which may provide frame structures with a variety of configurations. For example, four frame elements 108 may provide frame structures with a square or rectangular configuration. The frame structures with four frame elements 108 may provide support along a top portion of the outer and inner layers 102, 104 proximate to the opening defined by the inner layer 104. In particular, and with reference to FIG. 4, horizontally extending covers 112 may be joined to the front and back inner panels 128, 132 proximate to the opening defined by the inner layer 104. The additional frame element 108 for each frame structure 106*a-b* (as compared to the three frame element structures) may not be joined to other frame elements 108 but may provide some rigidity to the upper portions 166, 168 of either front or back exterior and/or inner panels 114, 118, 128, 132 of the inner and outer layers 102, 103. Alternatively, the additional frame elements 108 may be joined to vertically extending frame elements 180 or to the outer layer 102 by any suitable connection structure such as mechanical fasteners (e.g., threaded screws, stitches, rivets, snaps and so on), adhesives, welds, or any other known connection mechanism.

In some implementations, one or more frame elements 108 may extend along bottom lengths of the side inner panels between the supports of the first and second frames 106*a-b* to add support, reinforcement, and/or rigidity between the front exterior and/or inner panels 114, 128 and back exterior and/or inner panels 118, 132 of the luggage piece 100. In this example, the first and second frames 106*a-b* may be joined such as by a third frame element connection structure 158 provided on each frame support 100, and the assembly may form a single operative frame structure with an open box-like configuration.

In another example, a frame structure may be provided along the side exterior and/or inner panels 116, 130 of the luggage piece 100 in addition or as an alternative to the first and second frames 106*a-b*.

The frame structures 106*a-b* may be configured with frame elements 108 extending in multiple directions including horizontally, vertically, and diagonally (not shown). In the embodiments shown in FIG. 2, horizontal frame elements 108 may extend between the frame supports 110 at the front exterior and/or inner panels 114, 128 or at the back exterior and/or inner panels 118, 132 of the luggage piece along the outer periphery or edges of these panels. In some implementations, the frame elements 108 may extend horizontally or vertically along a mid-region of the panels of the luggage piece 100, such as between the lower and upper portions of the exterior and/or inner panels 114, 116, 118, 128, 130, 132. The frame elements 108 may extend diagonally across the front, back, or side exterior and/or inner panels 114, 116, 118, 128, 130, 132 of the luggage piece 100 to provide crosswise support and reinforcement across these panels. In addition or alternatively, the frame elements 108 may extend diagonally and join a frame support 110 for the first frame 106*a* to a frame support 110 for the second frame 106*b* to provide crosswise support and reinforcement to the bottom exterior and/or inner panel 120, 134.

The frame elements 108 may be joined to the frame supports 110 or any other suitable connection structures, which may allow the frame structures 106*a-b* to be joined directly to the outer layer 102, to the inner layer 104, or both. For example, the frame element free ends 142 may be joined to a frame support 110 connected to an upper portion of the outer layer 102. In another example, the horizontally extending frame elements 108 arranged in covers 112 at the upper portion of the inner layer 104 may have their free ends joined to vertically extending frame elements 108, may be joined to the outer layer 102, or both.

FIG. 5 shows a cross-section view of the luggage piece 100 of FIG. 1, viewed along line 5-5. With reference to this figure, a frame element 108 is shown arranged between the inner layer 104 and the cover 112 within the space defined by the outer layer 102. The frame element 108 may not be visible to a user accessing the compartment or compartments of the luggage piece 100 defined by the inner layer 104 due to the positioning of the frame element 108 between the inner layer 104 and the cover 112.

Figure 6:
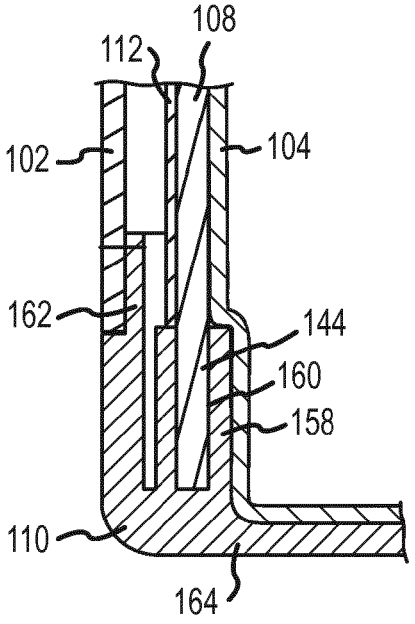
FIG. 6 shows a cross-section view of the luggage piece of FIG. 1, viewed along line 6-6 in FIG. 1.

FIG. 6 shows a cross-section view of the luggage piece 100 of FIG. 1, viewed along line 6-6. With reference to this figure, a frame element 108 is joined to a frame support 110 via a frame connection structure 158. The frame support 110 and frame connection structure 158 may be integrally formed with one another, and the frame element 108 may be securely arranged within the space defined by the internal sidewall 160 of the frame connection structure 158. The frame element 108 may be securely arranged within the cover channel 136 between the cover 112 and the inner layer 103. While the inner layer 104 is shown as abutting an end portion of the frame connection structure 158, the inner layer 104 may be formed of a deformable material that enables the inner layer 104 to move relative to the frame support 110, and therefore some clearance may be provided between the components. In some implementations, an end of the cover 112 may abut the opening of the frame connection structure 158, or the components may be spaced from one another. With further reference to FIG. 6, the outer layer 102 may be joined to the support edge 162 with the outer facing surface of the outer layer 102 flush with the outer facing surface of the frame support 110.

Figure 7:
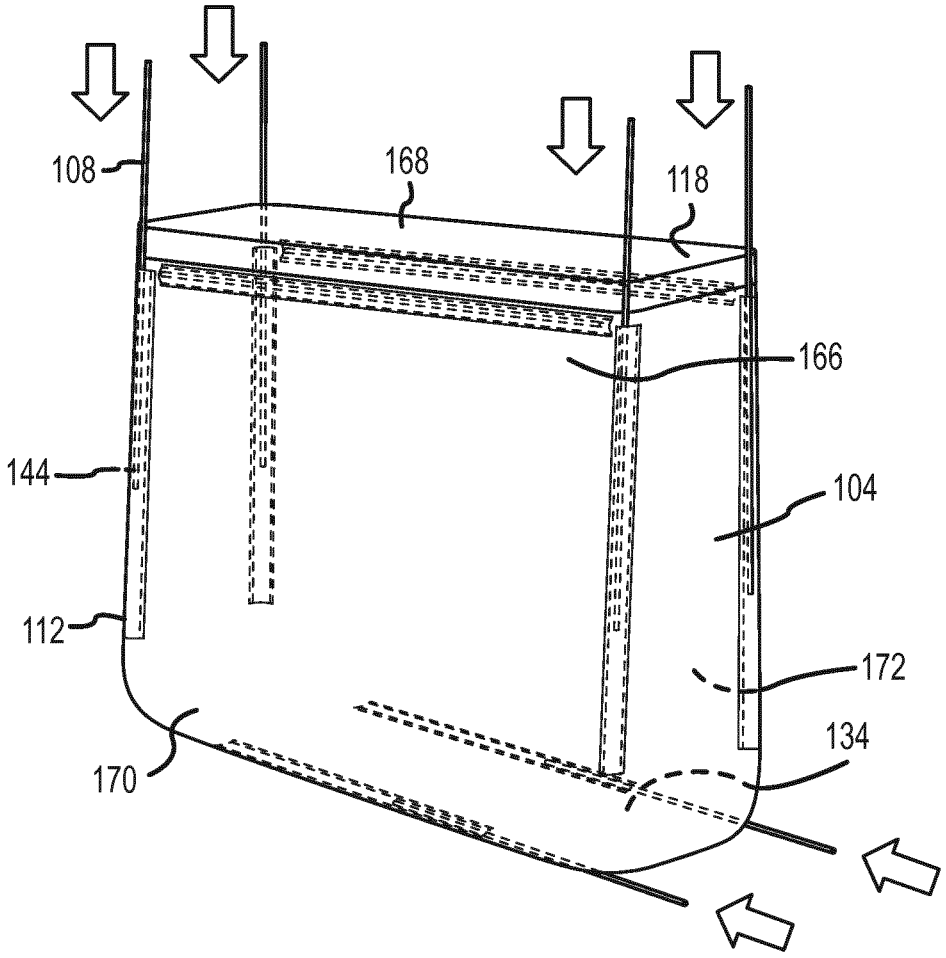
FIG. 7 shows a perspective view of the inner layer of FIG. 4, showing a partial joining of the frame elements to the inner layer.

FIGS. 7-10 illustrate a possible method of assembling the luggage piece 100. Referring to FIG. 7, the inner layer 104 may be provided assembled with covers 112 arranged in areas corresponding to portions of the luggage piece 100 to be supported and/or reinforced by the first and second frame structures 106*a-b*. The cover channels 136 may receive respective frame elements 108 by inserting one of the frame element end portions 144 into an opening defined by the cover 112 and the inner layer 104 and sliding the frame element 108 through the cover channel 136 until the inserted end portion of the frame element 108 exits a second opening, distal the first opening, defined by the cover 112 and the inner layer 104.

Figure 8:
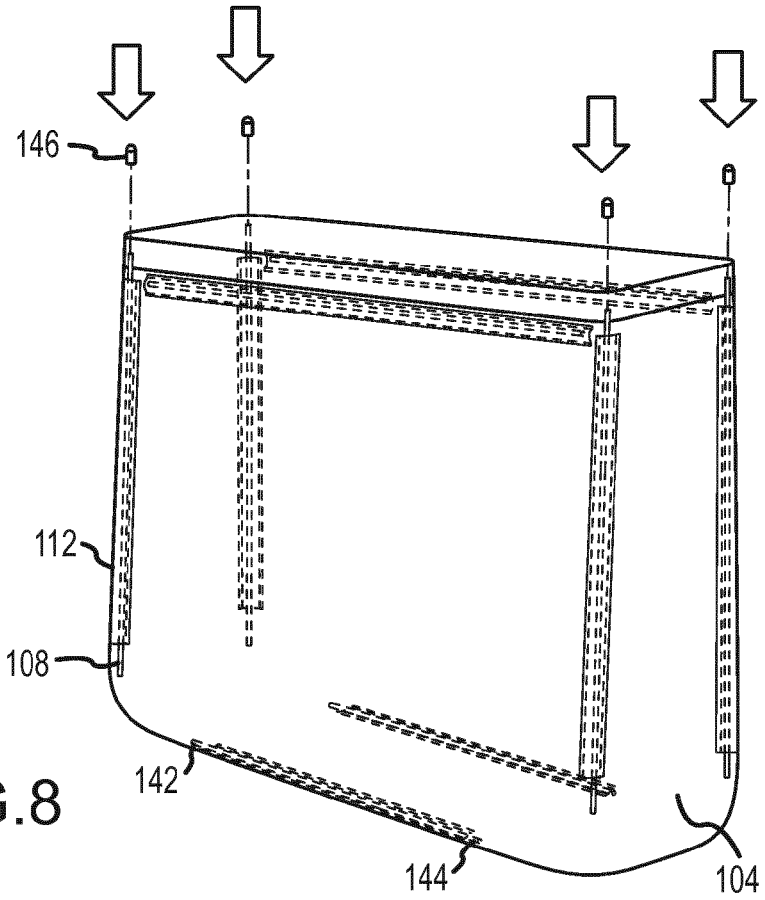
FIG. 8 shows a perspective of the inner layer and the frame elements of FIG. 7, showing the frame elements joined to the inner lining.

Referring to FIG. 8, the length of each frame element 108 may be longer than the length of its respective cover channels 136 to allow the end portions 142, 144 of the frame element 108 to be exposed from its respective cover 112 upon joining the frame element 108 to the inner layer 104 via the cover 112. Proximate to the opening defined by the inner layer 104, the exposed end portions 142 of the frame elements 108 may be fitted with protective elements 146, such as caps.

FIG. 9 shows the outer layer 102 assembled with frame supports 110 at the bottom corners 148. Each frame support 110 may include one or more frame connection structures 158 (not shown) as described above. To assemble the inner layer 104 and the frame elements 108 of FIG. 8 with the outer layer 102 and frame supports 110 of FIG. 9, the inner layer 104 may be inserted into the space defined by the outer layer 102 through the opening defined by the outer layer 102. During this process, the end portions 142, 144 of the frame elements 108 proximate to the frame supports 110 may be joined to the frame connection structures 158 of the frame frames 110 via the openings formed therein. For example, the vertically extending frame elements 108 may slide into the openings of the vertically extending frame connection structures 158 as the inner layer 104 is inserted vertically into the outer layer 102, and the horizontally extending frame elements 108 may be inserted into the openings of the horizontally extending frame connection structures 158.

Upon assembly of the one or more frame structures 106*a-b* with the luggage piece 100, the frame structures 106*a-b* may provide a tent-like construction of the frame elements 108, frame supports 110, inner layer 104, and outer layer 102 that together may provide structure, support, and/or reinforcement to the corners and the edges of the luggage piece 100. Edges of the outer layer 102 and the inner layer 104 proximate to the openings defined by these layers 102, 104 may be joined using any suitable connection structure. As the inner layer 104 or the outer layer 102 joined thereto flexes (e.g., flexes inwardly, outwardly), the frame structures 106*a-b* may provide support, reinforcement, and/or rigidity to the outer layer 102 and the inner layer 104. For example, the frame structures 106*a-b* may provide support to the luggage piece 100, which may enable the position of the top exterior panel 122 and to the bottom exterior panel 120 of the luggage piece 100 to remain relatively fixed (e.g., the luggage piece 100 may resist vertical compression forces) and which may enable the position of the front and back exterior panels 114, 118 to remain relatively fixed (e.g., the luggage piece 100 may resist longitudinal compression). When frame elements 108 are provided between the first and second frames 106*a-b* (e.g., when four frame elements 108 extend along the bottom exterior panel 120 by its length and width), the position of the front and back exterior panels 114, 118 may remain relatively fixed (e.g., the luggage piece 100 may resist compression along its width) along at least a portion of the luggage piece 100 such as the lower portion, upper portion or both.

The method of assembly of the luggage piece 100 shown in FIGS. 7-10 is one possible assembly method, and a number of luggage piece assembly methods may be employed.

For example, another assembly method may include providing the outer layer 102 with one or more sections that can be opened to provide access to the space defined by the outer layer 102. For example, the front exterior panel 114 of the outer layer 102 may be opened along a vertically extending seam (FIG. 1) to provide access to the spaced defined by the outer layer 102, which may facilitate insertion of the frame elements 108 into the frame connection structures 158. After assembly of the frame structures 106*a-b*, the seam may be closed.

In another assembly method, the outer layer 102 may be provided in two pieces or sections and may be drawn together as the inner layer 104 and frame elements 108 are inserted into the outer layer 102 and the frame supports 110 provided therein.

In another assembly method, the frame supports 110 may be joined to the frame elements 108 prior to joining the frame supports 110 with the outer layer 102.

In another assembly method, the frame elements 108 may be joined to the frame connection structures 158 prior to assembly of the frame elements 108 with the inner layer 104. For example, one or more of the covers 112, or portions thereof, may be releasably attachable to the inner layer 104 to enable the covers 112 to receive the frame elements 108 within respective cover channels 136 after the frame elements 108 have been joined to the frame connection structures 158.

Some assembly methods may involve bending the frame elements 108, such as the horizontally extending frame elements 108, to allow the end portions 142, 144 of the frame elements 108 to be simultaneously received through the openings of respective frame connection structures 158. In addition or alternatively, one or more of the frame elements may be configured to be collapsible or pivotable to enable the frame elements to be inserted into the frame element connection structures with or without bending.

The frame connection structures 158 may be configured to pivot, rotate, slide, or some combination thereof, relative to the frame supports 110, which may facilitate insertion of the frame elements 108. For example, horizontally extending frame connection structures 158 may be movably joined to respective frame supports 110 to allow for engagement of the frame elements 108 by sliding the frame connection structures 158 over the end portions 142, 144 of the frame elements 108. One or more locking structures may lock the frame connection structures 158 in place upon joining them to the frame elements 108. The frame connection structures 158 may additionally or alternatively be configured with sidewall openings that enable the frame elements 108 to be inserted into respective frame connection structures 158 along the lengths of the frame elements 108 as opposed to by inserting the end portions 142, 144 of the frame elements 108 into the openings defined by respective frame connection structures 158. For example, the frame connection structures 158 may receive respective frame elements 108 via the sidewall openings, and the frame connection structures 158 may be rotated to move the sidewall openings to a position that prevents the frame elements 108 from exiting the sidewall openings.

Figure 11:
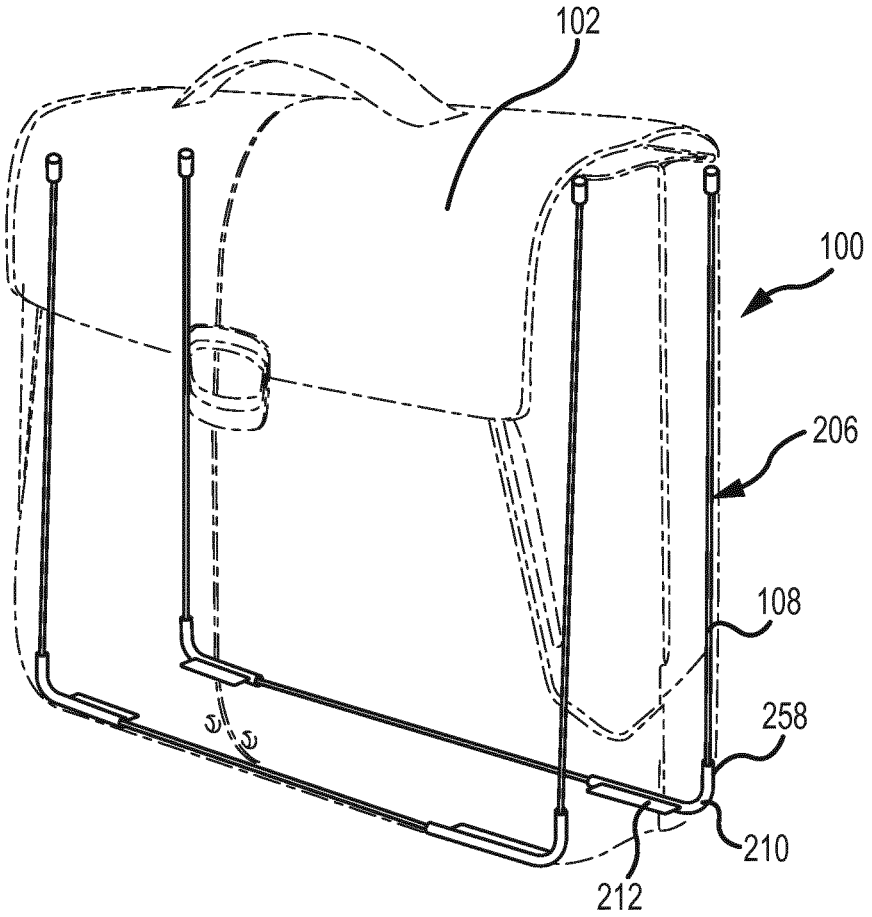
FIG. 11 shows a front perspective view of alternative first and second frames for the luggage piece of FIG. 1, with the outer layer shown in phantom line.

FIG. 11 shows alternative frame structures 206 for use with the luggage piece 100. The alternative frame structures 206 are generally similar to the frame structures 106*a-b* shown in FIGS. 2 and 3. As such, the alternate frame structure 206 generally function in a similar manner as the frame structures 106*a-b* shown in FIGS. 2 and 3, and they may be generally assembled with the inner layer 104, the outer layer 102, and other components of luggage piece 100 in a similar manner as the frame structure shown in FIGS. 2 and 3. However, the frame supports 210 for the alternative frame structures 206 differ from the frame supports 110 used for the frame structures 106*a-b* shown in FIGS. 2 and 3.

In particular, the frame supports 210 for the alternative frame structures 206 each include a bent frame connection structure 258, which may be generally cylindrical or tube-like and may include elongated holes at each end portion. Each elongated hole may be sized for receiving an end portion 142, 144 of a frame element 108 therein. Further, a plate-like connection structure 212 may extend radially away from the frame connection structure 258. This plate-like connection structure 212 provides a mechanism to facilitate joining the frame support 210 to the inner layer 103, the outer layer 102, or a combination thereof. Specifically, the plate-like connection structure 212 may be positioned between the outer and inner layers 102, 104 such that planar surfaces of the plate-like connection structure 212 abut surfaces of the outer and inner layers 102, 104. These abutting surface provide for contact areas between the plate-like connection structure 212 and the outer and inner layers 102, 104 that may be used to join the plate-like connection structure 212 to the outer and/or inner layers 102, 104 of the luggage piece 100 via a suitable connection method, such as sewing, adhering, or welding, these components together at these contact areas.

While the frame structures are described as being used with a luggage piece configured as a briefcase, the protective systems could be used with any type of luggage or with backpacks or other bags. The structures and functions of the implementations may be used interchangeably to form alternative implementations, as would be appreciated by those skilled in the art.

All directional references (e.g., upper, lower, upward, downward, left, right, leftward, rightward, top, bottom, above, below, vertical, horizontal, clockwise, and counterclockwise) are only used for identification purposes to aid the reader's understanding of the implementations of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the scope of the invention as defined in the appended claims.

What is claimed is:

1. A luggage piece comprising:

an outer layer including a front panel, a back panel, a bottom panel, and side panels;

a first frame including at least three first frame elements, each of the at least three first frame elements connected to an adjacent first frame element;

at least two first frame supports for connecting two adjacent first frame elements, at least one of the at least two first frame supports comprising either a plate-like structure or a support edge for securing the first frame to the outer layer;

a second frame including at least three second frame elements, each of the at least three second frame elements connected to an adjacent second frame element; and at least two second frame supports for connecting two adjacent second frame elements; wherein:

the at least three first frame elements support the outer layer for a first shape and a second shape of the luggage piece and allow portions of the outer layer to be altered without any of the first frame elements moving relative to the other first frame elements when changing the luggage piece from the first shape to the second shape or from the second shape to the first shape;

the at least three second frame elements support the outer layer for the first shape and the second shape of the luggage piece and allow portions of the outer layer to be altered without any of the second frame elements moving relative to the other second frame elements when changing the luggage piece from the first shape to the second shape or from the second shape to the first shape;

the first and second frames are selectively movable towards or away from each other to alter the luggage piece between the first shape and the second shape; and each of the first and second frame supports is attached to either the front panel or the back panel, and to either the bottom panel or a side panel.

2. The luggage piece of claim 1, wherein the first frame is at least partially positioned between the outer layer and an inner layer that is operatively joined to the outer layer.

3. The luggage piece of claim 2, wherein at least one of the at least three first frame elements is coupled to either the outer layer or the inner layer by being positioned within a channel defined by either the outer layer or the inner layer and a cover, and the cover is joined to either the outer layer or the inner layer.

4. The luggage piece of claim 1, wherein at least one of the at least two first frame supports is positioned at a corner of the luggage piece, and forms a portion of an outer surface of the luggage piece.

5. The luggage piece of claim 1, wherein at least one of the at least two first frame supports comprises a bent frame connection structure that includes at each end an elongated hole with each elongated hole sized to receive therein a portion of two adjacent first frame elements.

6. The luggage piece of claim 1, wherein:

when said at least one of the at least two first frame supports comprises a bent frame connection structure and the plate-like structure, the plate-like structure extends perpendicular to the bent frame connection structure.

7. The luggage piece of claim 1, wherein at least one of the at least three first frame elements includes an end portion that is not joined to either of the at least two first frame supports.

8. The luggage piece of claim 1, wherein one of the at least three first frame elements is joined to one of the at least two first frame supports at a first end portion of the one of the at least three first frame elements and is joined to another of the at least two first frame supports at a second end portion of the one of the at least three first frame-elements where the second end portion is distal from the first end portion.

9. The luggage piece of claim 1, wherein the at least three first frame elements and the at least two first frame supports are configured to form a generally U-shaped structure for the first frame.

10. The luggage piece of claim 1, wherein the at least two first frame supports reinforce the outer layer.

11. The luggage piece of claim 1, wherein the outer layer comprises a plurality of panels, and the first frame elements and first frame supports of the first frame are generally positioned along at least a portion of the periphery of one panel of the plurality of panels, and each panel of the plurality of panels is oriented to be generally orthogonal to adjacent panels of the plurality of panels.

12. The luggage piece of claim 1, wherein the outer layer comprises a flexible material.

13. The luggage piece of claim 1, wherein at least one of the at least three first frame elements comprises elongated fiberglass pultrusions.

14. The luggage piece of claim 1, wherein the first shape comprises an expanded configuration for the luggage piece, and the second shape comprises a collapsed configuration for the luggage piece.

15. The luggage piece of claim 1, wherein at least one of the at least three first frame elements reinforce the outer layer.

16. The luggage piece of claim 1, wherein the at least two first frame supports are generally positioned on an external peripheral corner of the outer layer or on an internal peripheral corner of the outer layer.

17. The luggage piece of claim 1, wherein each of the at least two first frame supports is attached to the bottom panel, a side panel, and to either the front panel or the back panel.

18. A luggage piece comprising:

an outer layer including a front panel, a back panel, a bottom panel, and side panels;

a first frame including at least three first frame elements operatively coupled by at least two first frame supports coupling adjacent frame elements, the first frame supporting the outer layer; and a second frame including at least three second frame elements operatively coupled by at least two second frame supports coupling adjacent frame elements, the second frame supporting the outer layer, wherein:

at least one of the at least two first frame supports comprises either a plate-like structure or a support edge for securing the first frame to the outer layer, at least one of the at least two second frame supports comprises either a plate-like structure or a support edge for securing the second frame to the outer layer, the luggage piece has no frame elements that join the first frame to the second frame, and the first frame and the second frame do not share any common frame supports;

the first frame, the second frame, and the outer layer are configured to allow selective movement of the first and second frames towards or away from each other to alter the luggage piece between a first shape and a second shape, wherein the first shape is an expanded configuration of the luggage piece, and the second shape is a collapsed configuration of the luggage piece; and each of the first and second frame supports is attached to either the front panel or the back panel, and to either the bottom panel or a side panel.

19. The luggage piece of claim 18, wherein the at least two first frame supports are generally positioned on an external peripheral corner of the outer layer or on an internal peripheral corner of the outer layer.

20. The luggage piece of claim 18, wherein each of the at least two first frame supports is attached to the bottom panel, a side panel, and to either the front panel or the back panel.

* * * * *